United States Patent [19]

Hulsey

[11] Patent Number: 4,961,232

[45] Date of Patent: Oct. 9, 1990

[54] UNDERHOOD HAVING COMBINED SKIRT AND RELEASE MEANS

[75] Inventor: David A. Hulsey, Meridian, Id.

[73] Assignee: Micron Technology, Inc., Boise, Id.

[21] Appl. No.: 371,319

[22] Filed: Jun. 26, 1989

[51] Int. Cl.[5] ..... A42B 1/18

[52] U.S. Cl. ..... 2/206; 2/205; 2/DIG. 7

[58] Field of Search ..... 2/2, 4, 5, 6, 7, 8, 2/9, 84, 171, 171.4, 171.5, 172, 173, 202, 203, 204, 205, 206, 410, 417, 420, 423, 424, 433, DIG. 7; 128/380

[56] References Cited

U.S. PATENT DOCUMENTS

| | | | |
|---|---|---|---|
| 3,100,896 | 8/1963 | Khanbegian | 2/6 |
| 3,134,891 | 5/1964 | Hyer | 128/380 |
| 3,660,850 | 5/1972 | Garbisch | 2/205 |
| 3,740,767 | 6/1973 | Schuessler | 2/173 |
| 3,955,570 | 5/1976 | Hutter | 2/DIG. 7 |
| 4,180,868 | 1/1980 | Snow | 2/172 |
| 4,573,217 | 3/1986 | Reed | 2/7 |
| 4,589,408 | 5/1986 | Singer | 2/205 |
| 4,593,417 | 6/1986 | Brown | 2/205 |
| 4,845,779 | 7/1989 | Wheeler | 2/84 |

FOREIGN PATENT DOCUMENTS

| | | | |
|---|---|---|---|
| 2306648 | 11/1976 | France | 2/202 |
| 556306 | 9/1943 | United Kingdom | 2/84 |
| 684962 | 12/1952 | United Kingdom | 2/206 |

*Primary Examiner*—Werner H. Schroeder
*Assistant Examiner*—Diana L. Biefeld
*Attorney, Agent, or Firm*—Stanley N. Protigal; Angus C. Fox; Jon P. Busack

[57] ABSTRACT

An underhood includes a helmet portion and a mask portion. The helmet portion consists of a loosely fitted bonnet which is attached to an elastic lower section. The elastic fabric (two-way stretch) substantially surrounds the bottom of the headdress in the manner of a headband, but is open below that location. A face mask secures the lower section around the user's face. The face mask is made of highly breathable fabric and relies on the elasticity of the stretch fabric in the lower part of the helmet portion for elastic fit around the user's face. Therefore, the face mask is relatively inelastic, while permitting elastic fit around the face.

14 Claims, 3 Drawing Sheets

UNDERHOOD HAVING COMBINED SKIRT AND RELEASE MEANS

FIELD OF THE INVENTION

This invention relates to cleanroom garments, and more particularly to a headgear garment known as an underhood, which has a capability of trapping particles which are generated from the head and face areas of the user. More particularly, the invention relates to face sealing features of the underhood.

BACKGROUND OF THE INVENTION

The invention is developed in order to provide additional cleanroom garb for cleanrooms having purity levels meeting federal and industry standards for a class 100 or cleaner cleanroom (Federal Standard 209 C/D). In such environments, particles generated by replenishment of human skin and particles which the cleanroom operator may carry in his hair are significant sources of contamination. For this reason, a cleanroom outfit consists of material which minimizes particle generation. The user generates additional particles which are sources of contamination, both from clothing worn beneath the cleanroom garb and from the user's body. For this reason, the cleanroom garb must also serve to trap such particles while the user is occupying the cleanroom.

The above functions would easily be accomplished with thin polyvinyl chloride sheeting and elastic bands, but for the need of the garment to ventilate human perspiration in order to provide comfort for the user. Certain fabrics, most notably cotton and wool have an ability to ventilate and also to wick moisture from the body. In very hot, dry weather, wool also provides maximum comfort. The same qualities make wool ideal as a woven fabric for cold climatic conditions. Unfortunately, most of these types of natural fibers are prone to particle generation. Other fabrics, most notably polyester, are less prone to particle generation, but are hydrophobic and therefore become uncomfortable in both hot and cold environments.

In cleanroom environments, climatic conditions can be readily controlled. While moisture is often maintained at a fairly high level, temperature can be precisely controlled, so that hydrophobic fabrics, such as polyester, may be comfortably worn as cleanroom garb, particularly when less hydrophobic fabrics are worn over large parts of the body beneath the cleanroom garb. Since the cleanroom garb covers a large proportion of the surface of the body, it is necessary that the fabric provide a fairly high degree of breathability.

One type of fabric which breathes easily and which is fairly comfortable is Teflon (TM for polytetrafluoroethylene or PTFE) coated fibers, such as Teflon coated polyester. Teflon coated fabrics are sold under the trademark Gore-Tex, by W. L. Gore, of Newark, Delaware. This type of fabric has proven to be rather comfortable. PTFE coated fibers are particularly comfortable when worn in combination with non-hydrophobic undergarments, when worn over the head, or when worn loosely. This fabric functions best when the base fiber is non-elastic.

U.S. Pat. No. 4,385,093, to Hubis, describes a method for producing a multi-component, porous PTFE article. Components of PTFE containing a liquid lubricant are placed in intimate contact, dried, and then stretched in one or more directions. The PTFE components may optionally contain a filler. The resultant product has a virtually uninterrupted structure and possesses very high bond strengths.

U.S. Pat. No. 4,194,041, to Gore, et al., is directed to a waterproof article for use in, for example, protective clothing. The article prevents liquid water from penetrating through to undergarments while at the same time permitting moisture vapor such as perspiration to pass out through the article. The article is thus both breathable and waterproof. The article is layered with a microporous hydrophobic outer layer which permits the passage of moisture vapor but resists penetration by liquid water at elevated pressures and a hydrophilic inner layer permitting the transfer of moisture vapor but preventing surface tension lowering agents such as those contained in perspiration and body oils from reaching the hydrophobic layer.

U.S. Pat. Nos. 3,962,153 and 4,187,390, to Gore, relate to a polytetrafluoroethylene polymer in a porous form which has an amorphous content exceeding about 5% and which has a micro-structure characterized by nodes interconnected by fibrils. The material has high porosity and high strength. It can be used to produce all kinds of shaped articles such as films, tubes, rods, and continuous filaments. Laminations can be employed and impregnation and bonding can readily be used to produce a large variety of articles. Compressed articles of very high strength can also be produced from these porous forms.

U.S. Pat. No. 4,025,679, to Denny, shows a fabric woven from oriented polytetrafluoroethylene (PTFE) strands, in which the strands of the weave are interconnected by a multiplicity of fine PTFE fibrils. To produce this fabric, consisting entirely of PTFE, a woven PTFE fabric is heated substantially unrestrained to a temperature above the crystalline melt point of PTFE and stretched. Alternatively, a woven PTFE fabric may be impregnated with other fluorocarbon polymers, heated substantially unrestrained to a temperature above the crystalline melt point of PTFE, and subsequently stretched, thereby generating a multiplicity of fine fibrils interconnecting the weave.

Cleanroom garb is, at best, inconvenient to put on and remove. While people are known to remain in the fab or other cleanroom areas for an entire 12-hour shift, the usual mode is to leave the cleanroom for coffee breaks, toilet, and meal breaks, each of which require a dress down and dress up of cleanroom garments. For this reason, it is desirable that the cleanroom garb be easily adjusted, usually by the mere act of putting the garment on. It is desirable that the easiest and the most natural way of putting the garment on also results in the most proper fit.

In the case of full headgear, the natural tendency is for a person not to place anything around the face. This means that a strap intended as a face mask and bib has a natural tendency of being worn as a chin strap or scarf. It is also quite important that the face mask be as loose fitting as possible and yet provide for sealing the garment around the face.

For this reason, the cleanroom garb is intentionally made to be fairly loose fitting. The loose fit also permits the garment to be worn by different users, with a minimum of different sizes required. Typically, four sizes are sufficient for most articles of cleanroom clothing.

Loose fitting "billowy styles" do not lend themselves to preventing escape of particles from the edges of the cleanroom garb. Our cleanroom design incorporates an air shower, in which air is continuously flowed from ceiling to floor. Therefore, particles coming from a bottom portion of cleanroom garb tend to be quickly removed from the cleanroom environment. On the other hand, top portions of the garb, such as the underhood, should be sealed. For this reason, the underhood is attached by means of a face mask which is adjusted in tension. This permits the fabric to be selected in accordance with the peripheral comfort of the user, while permitting adjustment to be accomplished by manually adjusting the face mask. In the prior art, this has been done by use of snaps or other fasteners.

Sealing of the garment is usually accomplished by adjustments and by elastic material. Elastic fabrics, such as Lycra (TM) have proven popular because they are less constraining than elastic bands co-mingled with material. The elastic fabric has a disadvantage in that it does not breathe as readily as non-elastic materials and the close fit afforded by the elastic material tends to be uncomfortable, particularly when combined with the reduced breathability of the material.

We would like to provide an underhood which is comfortable to the wearer and which provides an ample degree of sealing to prevent cleanroom contamination from the head area. It is important that the garment be comfortable and easy to remove and put on.

The fit of a cleanroom garment, such as an underhood, is important but sometimes conflicts with the ease at which can be put on and taken off. If a garment can be put on and removed as readily as, for example, a cowboy hat, the inconvenience to the user is reduced and the user is likely to properly adjust the garment. Furthermore, if the garment is easily adjusted and is comfortable, it is less probable that the garment will be put on "wrong." This is particularly true of headgear, which tends to be most critical and noticeable with respect to comfort and which is most difficult t fit properly.

A face mask is sometimes used in cleanrooms in order to prevent exposure of the cleanroom environment to contamination which would be caused by the user breathing in the cleanroom. It is likely that the face mask will be adjusted frequently, even if not in the immediate area of sensitive processes. When the face mask is adjusted, the underhood should prevent particles from escaping in the cleanroom.

It is also likely that the same cleanroom garment that is used in conjunction with a hood may also be used as an external garment without a hood. In other words, the underhood also must serve as an external head cover. The dual use implies that the garment must provide comfort in both circumstances, and also provide its cleanroom protection in both circumstances. This means that the dual purpose underhood must provide maximum comfort when worn with an external hood and be comfortable and provide sealing when the hood is removed. These two functions may conflict.

It is therefore desired to provide a tighter sealing function for an underhood. It is desired that the underhood be as comfortable as possible, including at the sealing part; and it is further desired that the adjustability of the underhood be as effortless as possible, thereby enabling the user to easily put the garment on properly and to be comfortable with the garment fitted properly. In other words, it is desired to provide an underhood which has improved comfort, sealing, and is easy to put on and which, because it is comfortable and easy to adjust, is more likely to be fitted properly when in use.

Users often have a wide variety of hair styles, ranging from bald to whatever version of a beehive hairstyle current fashion may dictate. While certain hairstyles are unaffected by tight-fitting headdresses, others are very much affected. A tight-fitting headdress may feel uncomfortable to some users. Since a loose fitting headdress would seldom be in the way of the user, it is advantageous that a hair cover be spacious. Also from a comfort standpoint, the head provides a significant portion of human temperature control. Since the hair draws moisture from the scalp, it is important that the maximum amount of breathability be provided through the headdress. Loose fit is comfortable and less likely to generate particles from friction. It is also desired to prevent loose particles from escaping from the headgear, even though loose fit is provided.

SUMMARY OF THE INVENTION

In accordance with the present invention, an underhood is provided which includes a helmet portion and a mask portion. The helmet portion consists of a loosely fitted bonnet which is attached to a lower section. The lower section is made of a two-way stretch fabric, which is below the headdress. Two-way stretch fabric substantially surrounds the bottom of the headdress in the manner of a headband. The lower section drapes down over and behind the user's ears in the manner of a kaffiyeh (although not folded).

The lower section is secured around the user's face by the mask portion which also functions to adjust and cause the lower section of the helmet portion to seal against the user's face. In the preferred embodiment, the face mask is made of highly breathable fabric and relies on the elasticity of the stretch fabric in the lower part of the helmet portion for proper fit around the user's face. Therefore, the face mask is relatively inelastic, while permitting a proper seal around the face.

DETAILED DESCRIPTION OF THE PREFERRED EMBODIMENTS

Figure 1:
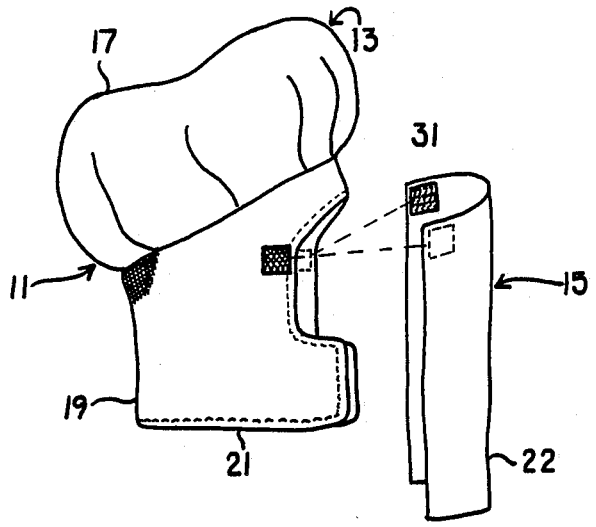
FIG. 1 shows a side view of an underhood according to a preferred embodiment of the invention.

The inventive underhood 11 consists of a helmet portion 13 and a face mask 15. The helmet portion 13 includes a bonnet part 17 and a face skirt 19.

The helmet portion 13 is placed over the user's head and the face mask 15 is unsecured against the user's face, thereby substantially covering the user's face and head. In the preferred embodiment, the underhood 11 is put on prior to securing a smock (not shown) or other jacket garment. In that manner, the underhood can be worn with its bottom edges 21, 22 underneath the smock. This allows articles generated beneath the underhood 11 to exit through the smock, rather than attempting to retain the particles or having the particles exit outside of the smock.

The bonnet 17 of the helmet portion 13 is preferably a non-elastic, very loosely fitting fabric. This accomplishes several things.

The bonnet 17 has a high breathability characteristic, which is important because it allows moisture to escape from the scalp through the hair. The face skirt 19, on the other hand, should be substantially conformal to the user's body. For this reason, it is made of stretch fabric, such as Lycra ( TM ). The face skirt 19 is formed or sewn to form a complete loop at "headband area," so that the face skirt 19 immediately below the bonnet 17 has a light elastic fit around the user's head.

The user would then place the helmet portion 13 so that the continuous loop is immediately above his eyebrows. This performs two functions. The helmet portion 13 is thereby secured to the user's head beneath the bonnet part 17. This is usually reasonably comfortable and prevents the underhood 11 from inadvertently slipping off or falling down over the user's eyes. By being elastic, the "headband area" (immediately below the bonnet 17) prevents debris in the user's hair from escaping until such time as the user removes the underhood.

Advantageously, the elastic fit of the face skirt 19 adjacent to the bonnet 17 means that if the user releases the face mask in the room, the debris from the hair is not released at that time.

Figure 2:
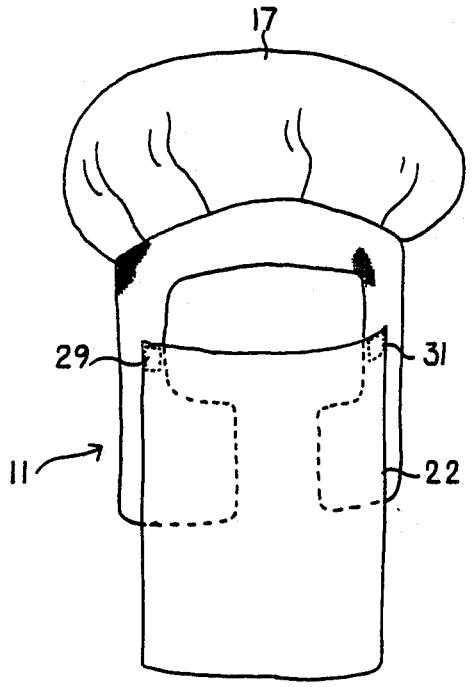
FIG. 2 shows a front view of the underhood of FIG. 1.

In the preferred embodiment, the skirt 19 remains loose in the front below the user's eyes. As shown in FIGS. 1–2 the face skirt 19 does not form a closed loop below the eye level. In the preferred embodiment the face skirt 19 is made of two-way stretch material, but, since the face skirt 19 forms a secured closed loop only adjacent the bonnet 17 and across the face mask 15 (as will be explained), the stretch material of the head skirt 19 includes large portions of stretch fabric which is in a relaxed or unbiased state.

The face mask 15 is attached to the face skirt 19 and is preferably made of non-elastic fabric. Attachment points 29, 31 of the face mask are approximately midway between the user's eyes and the center of the ears. On one side, the face mask may be sewn (attachment 29), but hook-and-pile loop type fasteners (Velcro TM ) are used for the opposite attachment point 31. This enables the user to place the underhood over the head and then secure the underhood by attaching the face mask 15. The attachment of the face mask 15 to the face skirt 19 establishes a sealing effect which extends to the face mask 15. The elasticity of the face skirt 19 provides tension and this tension is adjusted by the user when he engages the fastener 31.

The position of the fasteners 29, 31 is established by a need to secure the underhood 11 and to make it comfortable for the user to position the face mask 15 at an optimum position for the face mask 15. The face mask 15 is preferably made of non-elastic material which is also non-absorbent. Elasticity of the face mask 15 is achieved by the stretch material of the face skirt 19 to which the face mask 15 is attached. This means that the face mask 15 is non-yielding, but instead is able to shift across the face of the user as stress applied to the face mask 15 exceeds the ability of the material in the face mask 15 to deform. This is a desirable feature since the face mask 15 stretching across parts of the face could prove to be less than comfortable, as compared to the face mask 15 being tensioned by the face skirt 19.

Figure 3:
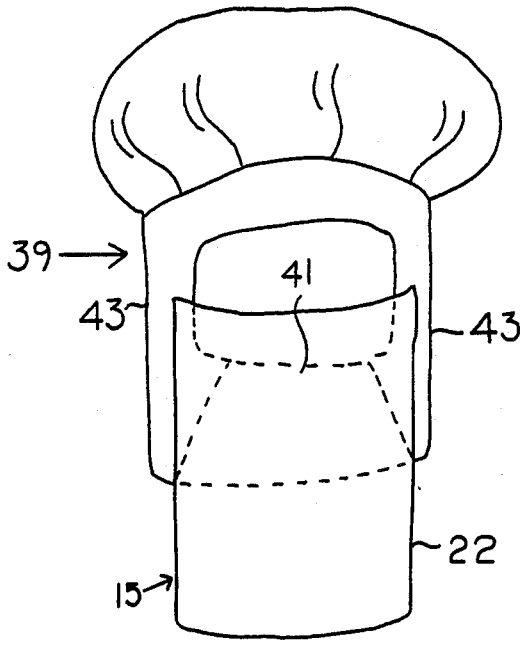
FIG. 3 shows a front view of an alternate embodiment of the invention, which includes a chin strap.

FIG. 3 shows an alternate embodiment of the invention, where a modified face skirt 39 includes a chin strap 41. The chin strap 41 may be made of non-elastic material, so that side portions 43 of the face skirt 39 provide a tensioning effect on the chin strap 41. This tension is then adjusted by the adjustable fitment of the face mask 15. The tensioning of the face mask 15 on the face skirt 39 results in the face mask 15 pulling on the face skirt 39 in a manner similar to that shown in FIGS. 1 and 2. This results in the side portions 43 being withdrawn and increasing tension on the chin strap 41.

Clearly, numerous changes may be made to the preferred embodiment. For example, different combinations of elastic and non-elastic materials may be used to achieve the inventive effects. Therefore, the invention should be read as limited by the claims.

What is claimed is:

1. Cleanroom garment for protecting an environment from contamination from the wearer's head and face, characterized by:

(a) a bonnet part constructed to cover most of the user's scalp hair and fit loosely, and having a lower open end fitted to encircle the wearer's scalp in the manner of a brim hat;

(b) the bonnet part being constructed of fabric which is selected to have a maximum degree of breathability of humid air, and which has a porosity which does not exceed that required to block cleanroom contaminants from escaping from the wearer's body through the bonnet part;

(c) a face skirt part attached to the lower bonnet part and substantially encircling the wearer's head, the lower open end of the bonnet part and said attachment to the lower open end of the bonnet part being effected so as to seal the lower open end of the bonnet part against the face skirt part;

(d) the face skirt part extending from the lower open end of the bonnet part to a location below the wearer's head, thereby permitting the face skirt part to be tucked beneath a shirt garment worn by the user;

(e) the face skirt part being constructed of fabric having an elastic property, so that the face skirt conformally fits against the wearer's scalp at the location of the attachment of the face skirt part to the lower open end of the bonnet part;

(f) the encirclement of the face skirt part around the wearer's head discontinuing below the attachment to the lower open end of the bonnet;

(g) the face skirt part being constructed of fabric which is selected to have an ability to wick moisture from the user's skin, while retaining breathability of humid air, and which has a porosity which does not exceed that required to block cleanroom contaminants from escaping from the wearer's body through the face skirt part;

(h) a face mask, the face mask being constructed of fabric which is selected to have an ability to wick moisture from the user's skin, while retaining breathability of humid air, and which has a porosity which does not exceed that required to block cleanroom contaminants from escaping from the wearer's body through the face mask;

(i) the face mask being constructed of substantially non-elastic fabric which is selected to have an ability to wick moisture from the user's skin, while retaining breathability of humid air, and which has a porosity which does not exceed that required to block cleanroom contaminants from escaping from the wearer's body through the face skirt part; and (j) attachments for attaching the face mask to the face skirt part, including at least one adjustable attachment, the attachments located on the face skirt at positions such that the wearer, upon securing the face mask across the face, will position the face mask properly by securing the face mask for comfort;

(k) the cleanroom garment providing an elastic bias of the face mask across the wearer's face, the elastic bias of the face skirt part providing a desired tension across the face mask which is adjustably established by said securing the face mask across the face by means of said adjustable attachment, the elastic bias being effected without deformation of the face mask around the wearer's face, although the elastic property permits the face skirt to stretch during movement of the wearer.

2. Cleanroom garment as described in claim 1, further characterized by:

the bonnet part being constructed of a substantially non-elastic fabric, and being fitted to be loosely fitting.

3. Cleanroom garment as described in claim 1, further characterized by:

the bonnet part having a high breathability characteristic, which provides said maximum degree of breathability of humid air, thereby allowing moisture to escape from the scalp through the hair.

4. Cleanroom garment as described in claim 1, further characterized by:

the attachment of the face skirt part to the bonnet part avoiding the garment inadvertently slipping off the user's head and avoiding the garment falling down over the user's eyes.

5. Cleanroom garment as described in claim 1, further characterized by:

the face skirt part not forming a closed loop below the wearer's eye level, so that the material of the face skirt part is in a relaxed unbiased state.

6. Cleanroom garment as described in claim 1, further characterized by:

the face mask being attached to the face skirt part approximately mid-way between the user's eyes and the center of the ears while the garment is being worn, thus enabling the user to place the underhood over the user's head and then secure the underhood by attaching the face mask, the attachment of the face mask to the face skirt part establishes a sealing effect which extends to the face mask.

7. Cleanroom garment as described in claim 1, further characterized by:

the face mask being made of non-elastic fabric, wherein the elasticity of the face skirt part provides tension and this tension is adjusted by the user when the user engages the adjustable attachment.

8. Cleanroom garment as described in claim 1, further characterized by:

(a) the face skirt part including a chin strap; and (b) the adjustable attachment of the face mask controlling tension on the chin strap.

9. Cleanroom garment as described in claim 1, further characterized by:

(a) the face skirt part including a chin strap, the chin strap being made of non-elastic fabric, wherein the elasticity of the face skirt part provides tension to the chin strap; and (b) the adjustable attachment of the face mask controlling tension on the chin strap.

10. Cleanroom garment as described in claim 1, further characterized by:

(a) the face mask being made of non-elastic fabric, wherein the elasticity of the face skirt part provides tension and this tension is adjusted by the user when the user engages the adjustable attachment;

(b) the face skirt part including a chin strap, the chin strap being made of non-elastic fabric, wherein the elasticity of the face skirt part provides tension to the chin strap; and (c) the adjustable attachment of the face mask controlling tension on the chin strap.

11. Cleanroom garment as described in claim 1, further characterized by:

(a) the face skirt part being constructed to be substantially conformal to the user's body;

(b) the face skirt part being made of elastic fabric; and (c) the face skirt part forming a complete loop at a "headband area," where the face skirt part is attached to the lower bonnet part so that the face skirt part immediately below the bonnet part has a light elastic fit around the user's head.

12. Cleanroom garment as described in claim 11, further characterized by:

(a) the face skirt part including a chin strap; and (b) the adjustable attachment of the face mask controlling tension on the chin strap.

13. Cleanroom garment as described in claim 11, further characterized by:

(a) the face skirt part including a chin strap, the chin strap being made of non-elastic fabric, wherein the elasticity of the face skirt part provides tension to the chin strap; and (b) the adjustable attachment of the face mask controlling tension on the chin strap.

14. Cleanroom garment as described in claim 11, further characterized by:

(a) the face mask being made of non-elastic fabric, wherein the elasticity of the face skirt part provides tension and this tension is adjusted by the user when the user engages the adjustable attachment;

(b) the face skirt part including a chin strap, the chin strap being made of non-elastic fabric, wherein the elasticity of the face skirt part provides tension to the chin strap; and (c) the adjustable attachment of the face mask controlling tension on the chin strap.

* * * * *